United States Patent [19]

Movrich

[11] Patent Number: 5,067,547

[45] Date of Patent: Nov. 26, 1991

[54] FABRIC COLUMN KIT AND SYSTEM

[75] Inventor: Wayne Movrich, LaGrange, Ill.

[73] Assignee: Rich Ideas, Inc., LaGrange, Ill.

[21] Appl. No.: 579,736

[22] Filed: Sep. 10, 1990

[51] Int. Cl.[5] ..... E06B 9/00

[52] U.S. Cl. ..... 160/327; 160/38

[58] Field of Search ..... 160/327, 354, 368.1, 160/328, 352, 19, 38, 330, 349.1; 52/63, 83, 222, DIG. 8, 423, 301; 248/265; 5/493

[56] References Cited

U.S. PATENT DOCUMENTS

| | | | |
|---|---|---|---|
| 977,565 | 12/1910 | Smith | 160/327 X |
| 2,261,142 | 11/1941 | Davis | 160/368.1 X |
| 2,809,003 | 10/1957 | Graham | 248/265 X |
| 3,185,207 | 5/1965 | Humble | 160/349.1 X |
| 3,196,511 | 7/1965 | Kintner | 160/330 |
| 3,683,994 | 8/1972 | Eichenlaub | 160/349.1 X |
| 4,907,637 | 3/1990 | Hintsa | 160/327 X |
| 4,912,901 | 4/1990 | Jerry | 52/301 |

*Primary Examiner*—David M. Purol

*Attorney, Agent, or Firm*—Wood, Phillips, Mason, Recktenwald & VanSanten

[57] ABSTRACT

In order to enhance the aesthetics of the interior of a home or building, a fabric column kit and system is disclosed. The fabric column kit or system includes at least a pair and, preferably, a plurality of fabric supports which may advantageously be of different sizes and/or shapes wherein the supports are adapted for selected positioning in spaced apart relation in compatible pairs. The fabric supports are fixedly mounted to a rigid surface in selected positions. The fabric column kit or system also includes at least a pair and preferably a plurality of rings which may advantageously be of different sizes and/or shapes wherein the rings are adapted to releasably secure opposite ends of a fabric to the respective ones of the fabric supports. With the fabric column kit or system, a fabric column may be formed between the fabric supports to aesthetically enhance the interior space of any building structure.

19 Claims, 5 Drawing Sheets

FABRIC COLUMN KIT AND SYSTEM

FIELD OF THE INVENTION

The present invention is generally directed to interior decorating and, more particularly, aesthetically enhancing the interior space of a building structure.

BACKGROUND OF THE INVENTION

Over the years, there has been a growing awareness of the desirability for aesthetically enhancing the interior of a building structure. It is now well known that the aesthetics of a space which is to be inhabited has both a conscious and subconscious impact on those who are regularly exposed to that space. For instance, the color, texture, and materials for wall coverings and floor coverings are known to create or enhance certain moods.

In one area, there have been many diverse approaches concerning design techniques. In particular, the very different types of window and/or door treatments has run the gamut as to style and functionality over the course of history of interior decorating. While many interesting designs exist, a need has continued to exist for system and/or kits.

More specifically, it would be highly desirable for window treatments and/or door treatments to have significant versatility. This follows from not only the myriad of tastes in interior decorating but also from the very different types of windows and doors that are often encountered. Still further, it would be highly desirable to be able to change the "look" without having to change the overall "hardware".

The present invention is directed to overcoming one or more of the foregoing problems and achieving one or more of the resulting objects.

SUMMARY OF THE INVENTION

Accordingly, it is a principal object of the present invention to provide an entirely unique fabric column kit and system. It is a further object of the present invention to provide such an arrangement wherein the fabric column can be fashioned into different sizes and/or shapes by selectively utilizing components of the kit. It is an additional object of the present invention to provide components that are easy to use, inexpensive to manufacture, and require minimal tools.

In one respect, the present invention is directed to a fabric column system. The system includes a pair of fabric supports each adapted for selective positioning in spaced apart relation. Means are provided for fixedly mounting the fabric supports to a rigid surface in any of a variety of selected positions. The system also includes a fabric having opposite ends adapted for positioning adjacent ones of the fabric supports. Means are provided for releasably securing the opposite ends of the fabric to the respective ones of the fabric supports. Preferably, the releasable securing means includes a rod pocket ring for the fabric.

In an exemplary embodiment, the fabric supports each include a base plate and a hold down plate. It is also contemplated that the rings be adapted to fit through rod pockets which are suitably formed at opposite ends of the fabric. Further, means are provided for securing the hold down plates to the base plates with the rings therebetween.

Preferably, the base plates are formed to be larger than the rings and the rings are formed to be larger than the hold down plates. It is contemplated that the hold down plates will be generally of the same shape but smaller than the rings. With this construction, the securing means may comprise a bolt extending from each of the base plates through the respective one of the hold down plates.

Still further, the rings and hold down plates are preferably formed so as to be generally arcuate. This permits the hold down plates to each have an outer perimeter radially inwardly of the outer perimeter of the respective one of the rings when the hold down plates are secured to the base plates. As a result, the fabric may extend about the rings so as to hide the hold down plates from view.

In one highly preferred embodiment, the rings and hold down plates each define an arc extending through at least 180°. In this manner, these components may form a fabric column also extending through at least 180°. Preferably, the base plates will be larger than the rings and the rings and hold down plates will be centered thereon.

Additionally, the selected positions for mounting the fabric supports may in one application be advantageously vertically spaced at one side of a window. The rings and hold down plates may then each have a drapery-receiving void. Preferably, the drapery-receiving voids are arranged such that the fabric column is necessarily formed to have a vertically extending drapery-receiving void generally facing the window.

Alternatively, the selected positions for mounting the fabric supports are vertically spaced adjacent a doorway in which case the rings and hold down plates will have a wall-facing void. Specifically, the wall-facing void will then be arranged such that the fabric column is formed to also have a wall-facing void which generally faces a wall comprising the rigid surface.

Additional details of the fabric column system may include the utilization of a pair of retention brackets in one embodiment. Each of the retention brackets may advantageously extend between the rigid surface and the respective one of the fabric supports. As will be appreciated, the retention brackets may be provided to support and maintain the fabric supports in a desired orientation.

In an alternative embodiment, the releasable securing means also includes a rod pocket at each of opposite ends of the fabric. However, the fabric supports in this embodiment each include an open ring which is made to fit through the respective one of the rod pockets formed in the opposite ends of the fabric. In addition, the mounting means comprises a pair of brackets and the rigid surface comprises a wall upon which the brackets can be fixedly mounted.

In this embodiment, the brackets each have a pair of parallel, spaced apart openings adapted to receive opposite ends of the respective one of the open rings. These openings may advantageously be defined by a pair of tubular extensions. Still further, the brackets may each include a wall plate supporting the tubular extensions and having a pair of parallel slots each adapted to receive a tension screw.

With this arrangement, the tension screw is well suited for adjusting the wall plate position on the wall within the limits of the slots. Each of the wall plates may also include a pair of spaced apart holes each adapted to receive a final positioning screw for fixedly mounting the wall plates in the selected positions following adjustment. Still further, the tubular extensions may each include integral means for retaining the respective one of the opposite ends of the opening rings therein.

In this embodiment, the brackets may also each include a rigid ring support extending from the wall plate to the open ring. It will extend to a central point of the open ring remote from the wall plate. As a result, the rigid ring support holds the open ring in a preselected orientation relative to the wall against the weight of the fabric.

In still another embodiment, the releasable securing means may include a first strip of a hook and loop fastening means at each of the opposite ends of the fabric. The fabric supports then may include a base plate having at least one recess and which is formed into a desired shape for forming a fabric column. In addition, the releasable securing means may further include a second strip of the hook and loop fastening means about the outer perimeter of the base plates.

In still another embodiment, the releasable securing means may again include a first strip of a hook and loop fastening means at each of the opposite ends of the fabric. The fabric supports then each include a base plate having an outer perimeter formed into a desired shape for a fabric column. As before, the releasable securing means further includes a second strip of the hook and loop fastening means about the outer perimeter of the base plates.

In another respect, the present invention is directed to a fabric column kit including a plurality of fabric supports of different sizes and/or shapes adapted for selected positioning in spaced apart relation in compatible pairs. Means are provided for fixedly mounting the fabric supports to a rigid surface in selected positions. With this arrangement, the fabric column kit also includes a plurality of means for releasably securing opposite ends of a fabric to the respective ones of the fabric supports wherein such securing means are of different sizes and/or shapes.

Other objects, advantages and features of the present invention will be apparent from a consideration of the following specification taken in conjunction with the accompanying drawings.

DETAILED DESCRIPTION OF THE PREFERRED EMBODIMENTS

Figure 1:
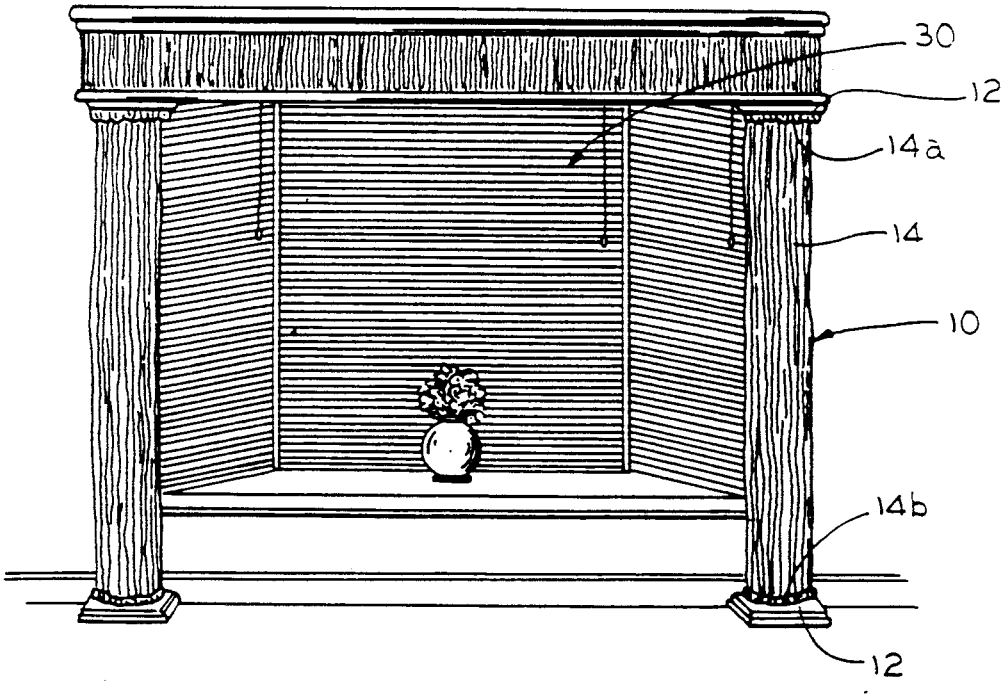
FIG. 1 is a perspective view of a fabric column system in accordance with the present invention.

In the illustrations given, and with reference first to FIG. 1, the reference numeral 10 designates generally a fabric column system which may be formed from a kit in accordance with the present invention. The system 10 includes a pair of fabric supports 12 each adapted for selected positioning in spaced apart relation. As also shown in FIG. 1, the system 10 includes a fabric 14 having opposite ends **14*a* and 14*b* adapted for positioning adjacent respective ones of the fabric supports 12 (see, also, FIG. 2**).

Figure 3:
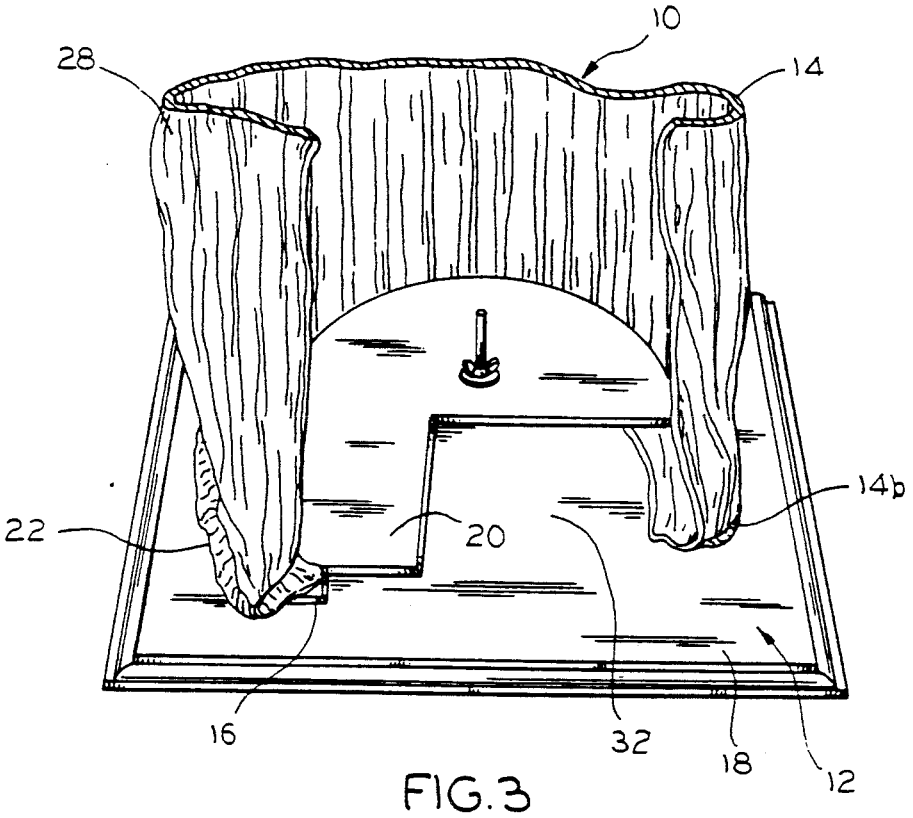
FIG. 3 is a partial perspective view showing other details of the fabric column system of FIG. 1.

As best shown in FIG. 3, the system 10 includes means for releasably securing the opposite ends **14*a* and 14*b* of the fabric 14 to the respective ones of the fabric supports 12. In particular, the releasable securing means includes a rod pocket ring 16 for the fabric 14 and the fabric supports 12 each include a base plate 18 and a hold down plate 20 whereby the rings 16 are adapted to fit through rod pockets 22 at the opposite ends 14*a* and 14*b* of the fabric 14. Further, the system 10 includes means for securing the hold down plates 20 to the base plates 18 in such a manner that the rings 16** are firmly retained in position therebetween.

Figure 4:
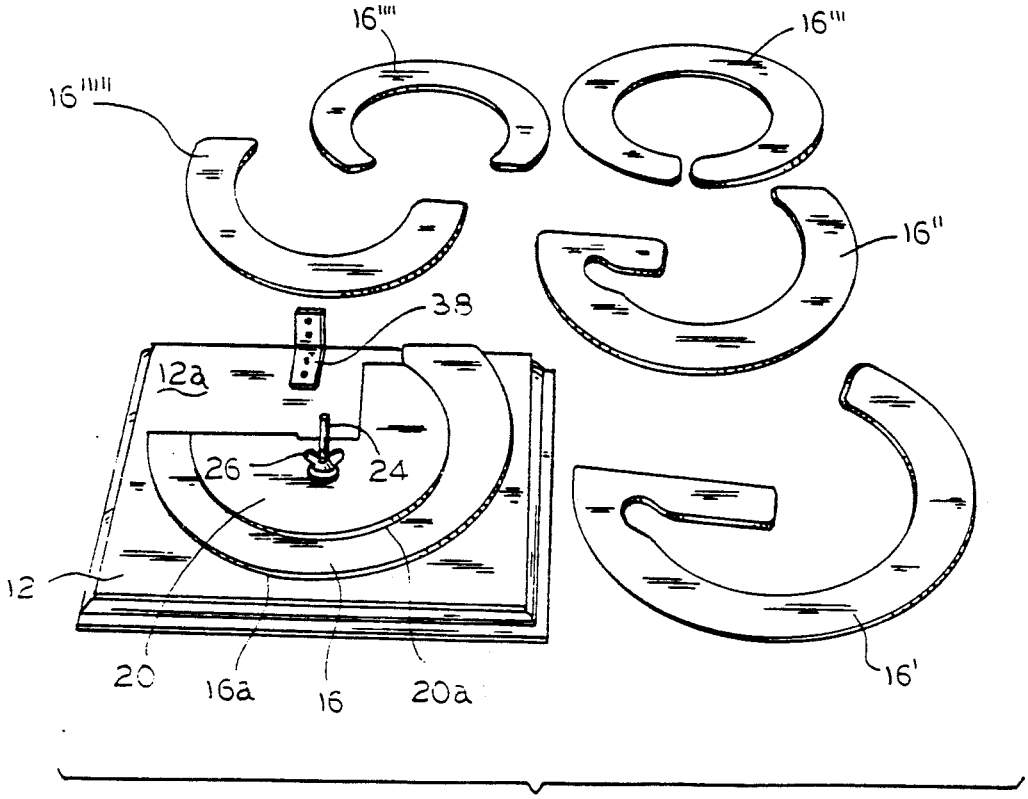
FIG. 4 is a perspective view showing certain components of the fabric column system of FIG. 1.

As will be appreciated from FIG. 4, the base plates 18 are larger than the rings 16 and the rings 16 are larger than the hold down plates 20. It will also be seen and appreciated that the hold down plates 20 are advantageously generally of the same shape but smaller than the rings 16. Preferably, the securing means comprises a bolt 24 extending from each of the base plates 18 through the respective one of the hold down plates 20 to cooperate with a wing nut 26.

Figure 2:
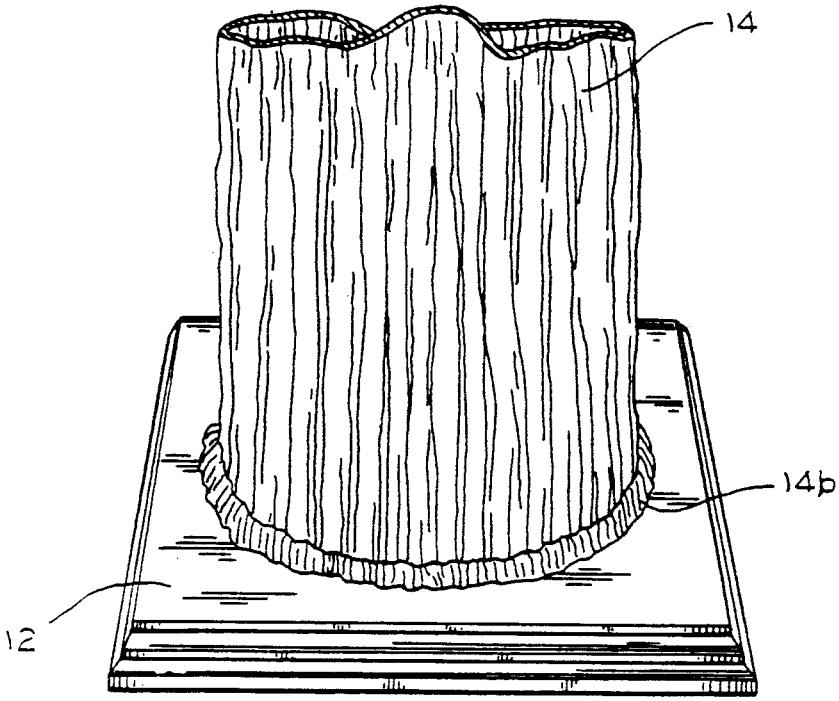
FIG. 2 is a partial perspective view showing certain details of the fabric column system of FIG. 1.

Still referring to FIG. 4, the rings 16 and hold down plates 20 may advantageously be formed so as to be generally arcuate. It will be seen that the hold down plates 20 each have an outer perimeter **20*a* radially inwardly of the outer perimeter 16*a* of the respective one of the rings 16 when the hold down plates 20 are secured to the base plates 18 by means of the bolt 24 and wing nut 26. As best shown in FIGS. 2 and 3, the fabric 14 will extend about the rings 16 so as to hide the hold down plates 20** from view.

Referring once again to FIG. 4, the rings 16 and hold down plates 20 may be generally arcuate and still be of a wide variety of different shapes and sizes. It will be appreciated that each of the illustrated rings 16, 16', etc. define an arc extending through at least 180° so as to form a fabric column 28 also extending through at least 180° (see FIG. 3). In the embodiment illustrated in FIGS. 1 through 4, the base plates 18 are larger than the rings 16 with the rings 16 and hold down plates 20 being centered thereon.

As will be appreciated from FIG. 1, the selected positions for fixedly mounting the fabric supports 12 are at vertically spaced locations generally at opposite sides of a window 30. The rings 16 and hold down plates 20 may each have a drapery-receiving void as at 32 (see FIG. 3). In this embodiment, the drapery-receiving voids 32 of the respective pairs of fabric supports 12 face each other and the window 30 so permit drawing draperies thereinto.

Figure 5:
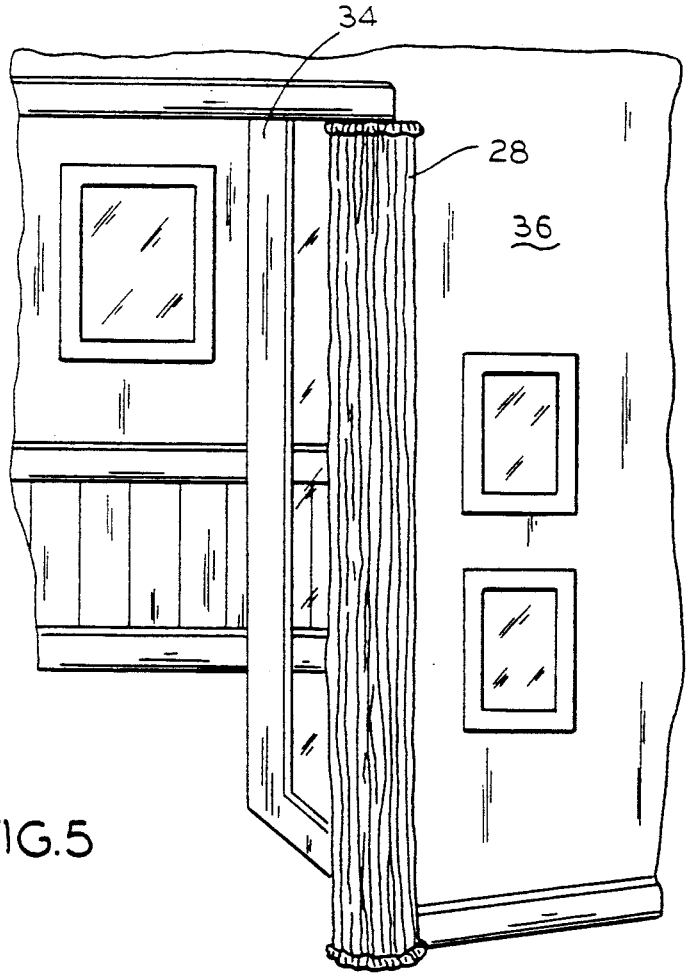
FIG. 5 is a perspective view of another embodiment of fabric column system of the present invention.

Alternatively, and referring to FIG. 5, the selected positions for mounting the fabric supports may be at vertically spaced locations generally adjacent a doorway 34. The embodiment illustrated in FIG. 5 is slightly different, and the details will be described hereinafter, but if the embodiment illustrated in FIGS. 1 and 4 is placed in a doorway, the rings 16 and hold down plates 20 each will have a wall-facing void essentially corresponding to the drapery-receiving void 32 previously described but possibly enlarged as would be the case by utilizing either of rings 16'''' or 16''''' (see FIG. 4). With such arrangements, the wall-facing void will naturally cause the fabric column 28 to have a corresponding wall-facing void generally facing a wall 36 or other rigid surface associated with the doorway 34.

Referring to FIG. 4, the system 10 also includes means for fixedly mounting the fabric supports 12 to a rigid surface such as a wall in selected positions. The mounting means preferably includes what comprises a pair of retention brackets 38 and each of the retention brackets 38 is formed so as to extend between the rigid surface or wall and the respective one of the fabric supports 12 as will be appreciated from FIG. 4. In the illustrated embodiment, the retention brackets 38 comprise angle brackets such as the one secured to the top surface 12*a* of the fixed support 12.

Figure 6:
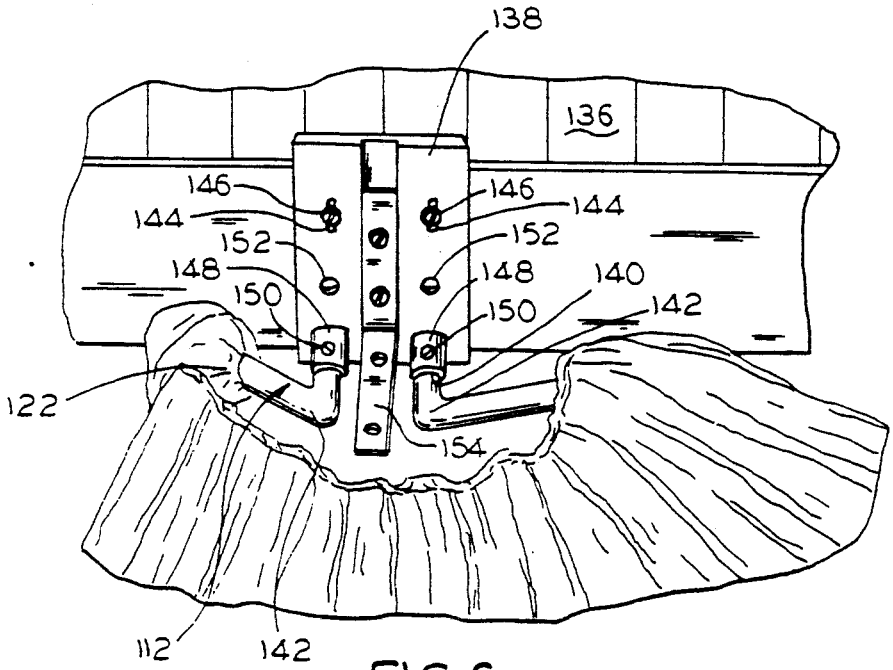
FIG. 6 is a partial perspective view showing certain details of the fabric column system of FIG. 5.
Figure 7:
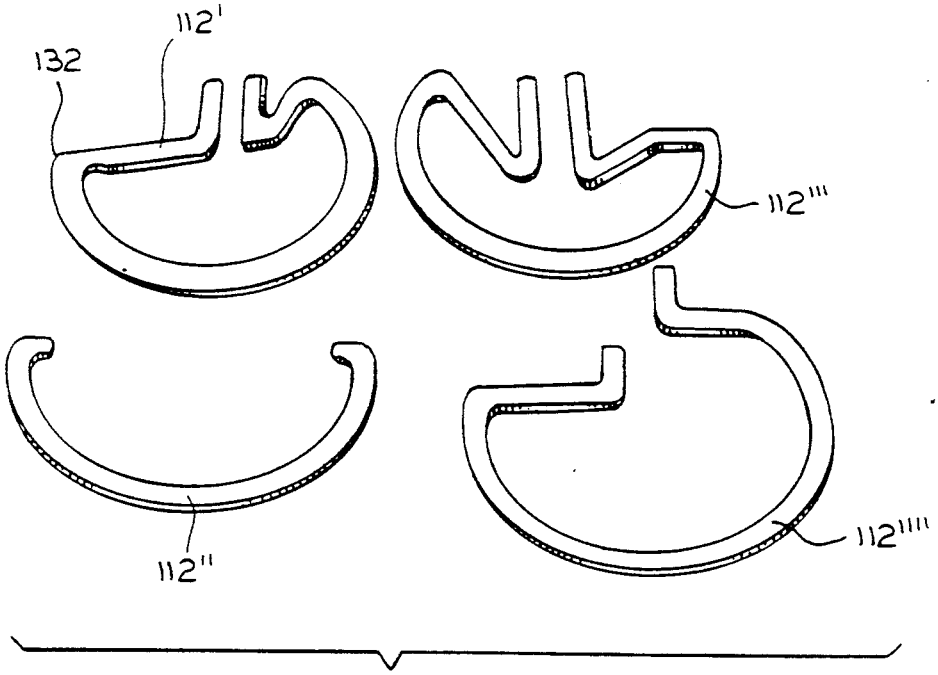
FIG. 7 is a top plan view showing certain components of the fabric column system of FIG. 5.

Referring now to FIGS. 6 and 7, an alternative embodiment of the present invention has been illustrated which includes a different form of fabric supports 112. The fabric supports 112, as illustrated, each comprise an open ring which is made to fit through the respective one of the rod pockets 22. As shown in FIG. 6, the mounting means comprises a pair of brackets 138 and the rigid surface comprises a wall 136 upon which the brackets 138 can be fixedly mounted.

As best shown in FIG. 7, the open rings 112 can be formed so as to have a variety of different sizes and/or shapes each defining an arc extending through at least 180°. The rings 112', 112'', etc. can thereby form a fabric column (such as 28 which is illustrated in FIG. 3 in connection with 180°. As shown in FIG. 6, the brackets 138 each have a pair of parallel, spaced apart openings 140 adapted to receive opposite ends 142 of the respective one of the open rings 112.

As will be appreciated, the brackets 138 each comprise a wall plate having a pair cf parallel slots 144 each adapted to receive a tension screw 146 for adjustment of wall plate position on the wall 136. It will also be seen that each of the wall plates 138 has a pair of tubular extensions 148 for receiving the opposite ends 142 of the respective one of the open rings 112 therein. These tubular extensions 148 define the spaced apart openings 140 (see FIG. 6). It will further be seen that the tubular extensions 148 include means for retaining the respective one of the opposite ends 142 of the open rings 112 therein. In the embodiment illustrated in FIG. 6, the retaining means may by way of example comprise set screws 150 for threadingly engaging the opposite ends 142 of the open rings 112 in the tubular extensions 148.

Still referring to FIGS. 6 and 7, the wall brackets 138 each include a pair of spaced apart holes 152 adapted to receive a final positioning screw for fixedly mounting the wall brackets 138 in the selected positions therefor. It will also be seen that the wall plates 138 may each have a rigid ring support 154 extending from the wall plate 138 to the open ring 112 at a central point remote therefrom. In this manner, the rigid ring support 154 can adequately support the open ring 112 in a preselected orientation relative to the wall 136 against the weight of the fabric.

As before, the selected positions for mounting the fabric supports 112 may be vertically spaced at opposite sides of a window or adjacent a doorway. It can be appreciated from FIG. 7 that the open rings such as 112' may include a drapery-receiving void 132 generally corresponding to the drapery-receiving void 32 in connection with the earlier described embodiment illustrated in FIG. 1 through 4. Alternatively, a wall-facing void may be provided, also as previously suggested, by forming an open ring such as 112''.

Referring to FIGS. 8 through 11, yet another embodiment of fabric column system has been illustrated wherein the releasable securing means comprises a first strip 260 of a hook and loop fastening means at each of the opposite ends of a fabric 214. The fabric supports 212 each include a base plate 216 having a recess or recesses 262 formed into a desired shape for a fabric column 228. As will be appreciated by those skilled in the art, the releasable securing means will further include a second strip 264 of the hook and loop fastening means about the outer perimeter of the base plates 216 to cooperate with the first strip 260.

Figure 9:
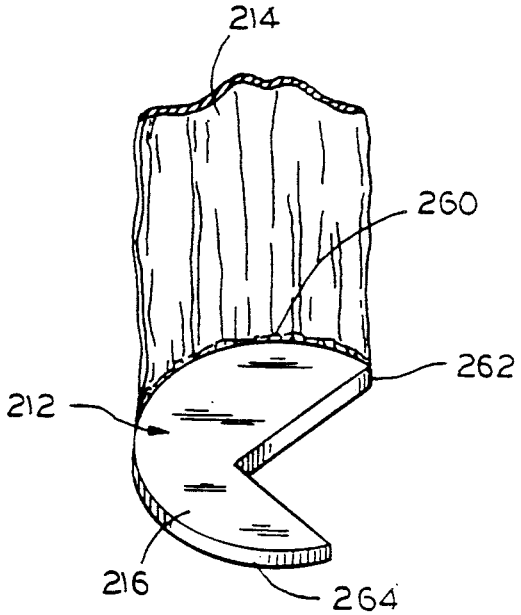
FIG. 9 is a perspective view showing certain details of the fabric column system of FIG. 8.
Figure 10:
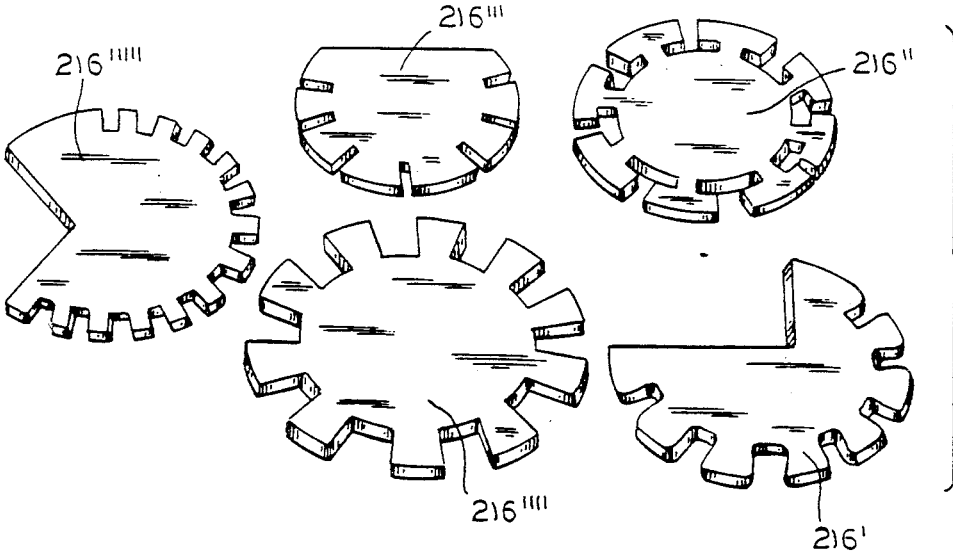
FIG. 10 is a top plan view showing certain components of the fabric column system of FIG. 8.

As best shown in FIG. 10, the base plates 216', 216'', etc. have outer perimeters which have been formed into various desired shapes for fabric columns. The overall configurations are generally circular or arcuate, although FIG. 9 illustrates that virtually any shape is a possibility. However, in keeping with typical column design, FIG. 10 is believed to illustrate the versatility of the invention in conformity with the shape of standard columns.

Figure 8:
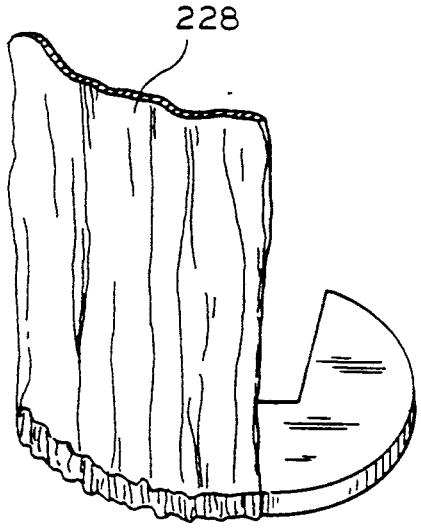
FIG. 8 is a partial perspective view of still another embodiment of fabric column system.
Figure 11:
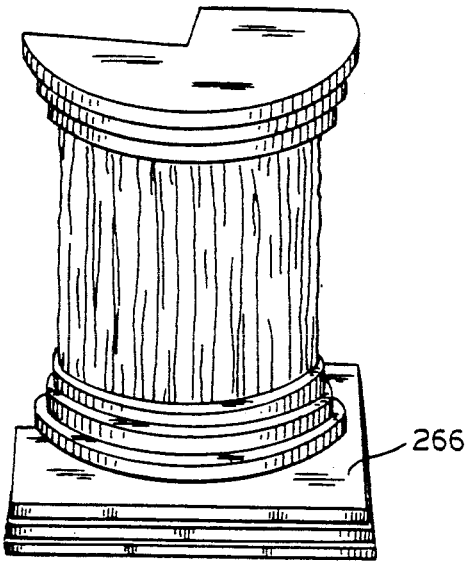
FIG. 11 is a perspective view of yet another embodiment of fabric column system.
Figure 13:
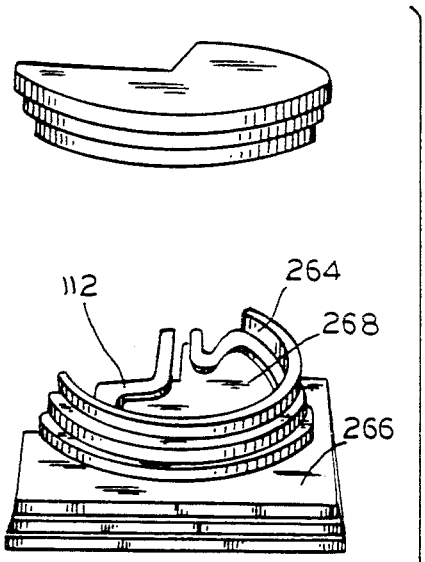
FIG. 13 is a perspective view showing other details of the fabric column system of FIG. 11.
Figure 12:
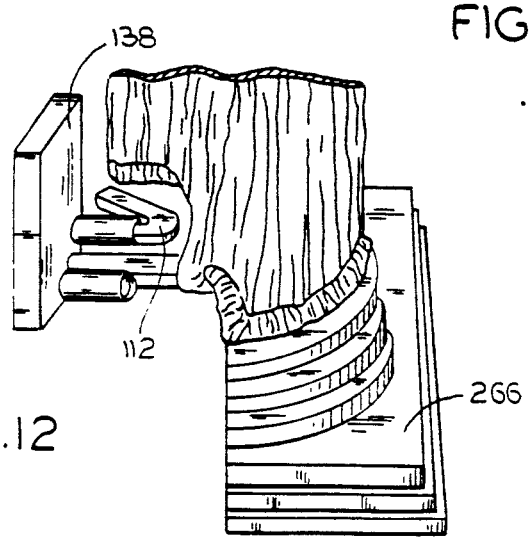
FIG. 12 is a perspective view showing certain details of the fabric column system of FIG. 11.

With the embodiment illustrated in FIGS. 8 through 10, the base plates 216 are essentially entirely hidden from view. Thus, the fabric columns 228 will essentially include no exposed base plates whatsoever at the opposite ends thereof. If desired, an entirely different form of base plate 266 may be utilized as shown in FIGS. 11 through 13.

In this connection, the base plate 266 may be formed as a capital. Thus, it may have a recess 268 wherein the first strip 260 of hook and loop fastening means is provided on the outwardly facing surface of &he fabric and the second strip 264 is provided on the inner surface of the recess 268 of the capital 266. In this manner, a fabric column system may be formed substantially as illustrated in FIG. 11.

As for FIGS. 12 and 13, they illustrate the utilization of capitals 266 with the embodiment previously described in connection with FIGS. 6 through 8. It will be seen and appreciated that the wall plates 138 are simply mounted such that the open rings 112 will be suitably positioned within the recesses 268 of the capitals 266. As a result, the capitals 266 provide for two alternative means of forming a fabric column therewith.

In another respect, the present invention will be understood to be directed toward and to provide a fabric column kit. The kit includes a plurality of fabric supports of different sizes and/or shapes adapted for selected positioning in spaced apart relation in compatible pairs. This can be appreciated by referring, e.g., to FIGS. 4, 7, 9, 10 and 13. The kit also includes a plurality of means of different sizes and/or shapes for releasably securing opposite ends of a fabric to the respective ones of the fabric supports. With such an arrangement, the kit will allow the purchaser to have a great deal of flexibility in designing a fabric column.

While in the foregoing there have been set forth preferred embodiments of the invention, it will be appreciated that the details hereingiven may be varied by those skilled in the art without departing from the true spirit and scope of the appended claims.

I claim:

1. A fabric column system, comprising:

a pair of fabric supports each adapted for selected positioning in spaced apart relation;

means for fixedly mounting said fabric supports to a rigid surface in selected positions;

a fabric having opposite ends adapted for positioning adjacent respective ones of said fabric supports; and means for releasably securing said opposite ends of said fabric to said respective ones of said fabric supports;

said releasable securing means including a rod pocket ring for said fabric, said fabric supports each including a base plate and a hold down plate and said rings being adapted to fit through rod pockets at said opposite ends of said fabric, and including means for securing said hold down plates to said base plates with said rings therebetween.

2. The fabric column system of claim 1 wherein said base plates are larger than said rings and said rings are larger than said hold down plates, said hold down plates being generally of the same shape but smaller than said rings, said securing means comprising a bolt extending from each of said base plates through the respective one of said hold down plates.

3. The fabric column system of claim 1 wherein said rings and hold down plates are generally arcuate, said hold down plates each having an outer perimeter radially inwardly of the outer perimeter of the respective one of said rings when said hold down plates are secured to said base plates, said fabric extending about said rings so as to hide said hold down plates from view.

4. The fabric column system of claim 1 wherein said rings and hold down plates are generally arcuate, said rings and hold down plates each defining an arc extending through at least 180 degrees so as to form a fabric column extending through at least 180 degrees, said base plates being larger than said rings and said rings and hold down plates being centered thereon 5. The fabric column system of claim 4 wherein said selected positions for mounting said fabric supports are vertically spaced at one side of a window, said rings and hold down plates each having a drapery-receiving void, said drapery-receiving voids being arranged whereby said fabric column is formed to have a vertically extending drapery-receiving void generally facing said window.

6. The fabric column system of claim 5 including a second pair of said fabric supports vertically spaced at the other side of said window, said rings and hold down plates thereof also having a drapery-receiving void, said drapery-receiving voids of the respective pairs of said fabric supports facing each other to permit drawing draperies on said window thereinto.

7. The fabric column system of claim 4 wherein said selected positions for mounting said fabric supports are vertically spaced adjacent a doorway, said rings and hold down plates each having a wall-facing void, said wall-facing void being arranged whereby said fabric column is formed to have a wall-facing void generally facing a wall comprising said rigid surface.

8. A fabric column system, comprising:

a pair of fabric supports each adapted for selected positioning in spaced apart relation;

means for fixedly mounting said fabric supports to a rigid surface in selected positions;

a fabric having opposite ends adapted for positioning adjacent respective ones of said fabric supports; and means for releasably securing said opposite ends of said fabric to said respective ones of said fabric supports;

said releasable securing means including a rod pocket at each of opposite ends of said fabric, said fabric supports each including an open ring fit through the respective one of said rod pockets and said mounting means comprising a pair of brackets, said rigid surface comprising a wall upon which said brackets can be fixedly mounted;

said brackets each including a wall plate having means extending from said wall plate to said open ring at a central point remote therefrom for supporting said open ring in a preselected relative orientation relative to said wall against the weight of said fabric.

9. The fabric column system of claim 8 wherein said open rings each define an arc extending through at least 180 degrees, said rings thereby forming a fabric column extending through at least 180 degrees, said brackets each having a pair of parallel, spaced apart openings adapted to receive opposite ends of the respective one of said open rings.

10. The fabric column system of claim 9 wherein said brackets each include a wall plate having a pair of parallel slots each adapted to receive a tension screw for adjustment of wall plate position on said wall and also having a pair of tubular extensions for receiving said opposite ends of the respective one of said open rings therein.

11. The fabric column system of claim 10 wherein each of said tubular extensions includes means for retaining the respective one of said opposite ends of the respective one of said open rings therein, and each of said wall brackets includes a pair of spaced apart holes each adapted to receive a final positioning screw for fixedly mounting said wall brackets in said selected positions.

12. A fabric column system, comprising:

a pair of fabric supports each adapted for selected positioning in spaced apart relation;

means for fixedly mounting said fabric supports to a rigid surface in selected positions;

a fabric having opposite ends adapted for positioning adjacent respective ones of said fabric supports; and means for releasably securing said opposite ends of said fabric to said respective ones of said fabric supports;

said releasable securing means including a first strip of a hook and loop fastening means at each of said opposite ends of said fabric, and said fabric supports each including a base plate having at least a portion with an outer perimeter defining a contour of a desired shape for a fabric column, said releasable securing means further including a second strip of said hook and loop fastening means conforming to said contour about at least a substantial portion of said fabric supports.

13. The fabric column system of claim 12 wherein said base plates each comprise a capital having a recess therein, said first strips of said hook and loop fastening means being disposed on an outwardly facing surface of said fabric, said second strips of said hook and loop fastening means being disposed within said recess of said capital.

14. A fabric column kit, comprising:

a plurality of fabric supports of different sizes and/or shapes adapted for selected positioning in spaced apart relation in compatible pairs;

means for fixedly mounting said fabric supports to a rigid surface in selected positions, and a plurality of means of different sizes and/or shapes for releasably securing opposite ends of a fabric to said respective ones of said fabric supports;

said releasable securing means including rod pocket rings for said fabric, said fabric supports each including a base plate and a hold down plate and said rings being adapted to fit through rod pockets at opposite ends of said fabric, and including means for securing said hold down plates to said base plates with said rings therebetween.

15. The fabric column kit of claim 14 wherein said base plates are larger than said rings and said rings are larger than said hold down plates, said hold down plates being generally of the same shape but smaller than said rings, said securing means comprising a bolt extending from each of said base plates through the respective one of said hold down plates.

16. The fabric column kit of claim 14 wherein said rings and hold down plates are generally arcuate, said hold down plates each having an outer perimeter radially inwardly of the outer perimeter of the respective one of said rings when said hold down plates are secured to said base plates, said fabric extending about said rings so as to hide said hold down plates from view.

17. The fabric column kit of claim 14 wherein said rings and hold down plates are generally arcuate, said rings and hold down plates each defining an arc extending through at least 180 degrees so as to form a fabric column extending through at least 180 degrees, said base plates being larger than said rings and said rings and hold down plates being centered thereon.

18. A fabric column kit, comprising:

a plurality of fabric supports of different sizes and/or shapes adapted for selected positioning in spaced apart relation in compatible pairs;

means for fixedly mounting said fabric supports to a rigid surface in selected positions; and a plurality of means of different sizes and/or shapes for releasably securing opposite ends of a fabric to said respective ones of said fabric supports;

said releasable securing means including an outer perimeter of said fabric supports defining a contour for said fabric, and said fabric supports each including a base plate having said outer perimeter associated therewith and formed into a desired size and/or shape for a fabric column, said releasably securing means further including strips of a hook and loop fastening means conforming to said contour about at least a substantial portion of said fabric supports and at opposite ends of said fabric.

19. The fabric column kit of claim 18 wherein said base plates each comprise a capital having a recess therein, said first strips of said hook and loop fastening means being disposed on an outwardly facing surface of said fabric, said second strips of said hook and loop fastening means being disposed within said recess of said capital.

* * * * *